US007249473B2

(12) United States Patent
Rizzeto et al.

(10) Patent No.: US 7,249,473 B2
(45) Date of Patent: Jul. 31, 2007

(54) WASHING AID DISPENSER AND WASHING MACHINE COMPRISING SAID DISPENSER

(75) Inventors: Pietro Rizzeto, Santo Stino di Livenza Venezia (IT); Arturo Gamba, Prodenone (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 574 days.

(21) Appl. No.: 10/390,480

(22) Filed: Mar. 17, 2003

(65) Prior Publication Data

US 2004/0011089 A1 Jan. 22, 2004

(30) Foreign Application Priority Data

Mar. 19, 2002 (IT) ..... PN20020017 U

(51) Int. Cl.
*D06F 29/00* (2006.01)

(52) U.S. Cl. ..... 68/17 R

(58) Field of Classification Search ..... 68/17 R
See application file for complete search history.

(56) References Cited

U.S. PATENT DOCUMENTS 3,086,379 A * 4/1963 Plante ..... 68/12.13
3,696,970 A * 10/1972 Bunnell et al. ..... 222/145.1
4,265,100 A * 5/1981 Kretchman et al. ..... 68/12.18
4,700,554 A * 10/1987 Eichman et al. ..... 68/17 R
6,449,779 B1 * 9/2002 Nguyen ..... 4/225.1
2003/0145633 A1 * 8/2003 Merkle et al. ..... 68/17 R

FOREIGN PATENT DOCUMENTS

DE 3714301 A1 * 11/1988
EP 0225220 A 6/1987
EP 225220 A1 * 6/1987
GB 2165267 A 4/1986
GB 2187764 A * 9/1987
SU 1774183 A1 * 11/1992

OTHER PUBLICATIONS

British Search Report, Publication No. GB2386613, May 7, 2003.

* cited by examiner

*Primary Examiner*—Michael Barr
*Assistant Examiner*—Sarah Husband
(74) *Attorney, Agent, or Firm*—Pearne & Gordon LLP

(57) ABSTRACT

The present invention refers to a washing aid dispenser for a washing machine. The dispenser (2) comprises at least a compartment (3) adapted to contain washing aid products, such as a rinse aid or fabric softener, provided with a first siphon (4) having pre-determined head and diameter and adapted to transfer said washing aid substances into the washing tub of the machine when the water in the compartment (3) reaches up to a priming level corresponding to said pre-determined head.

In the compartment (3) there is further provided at least a second siphon (9) having greater head and diameter than said first siphon (4) and adapted to transfer said washing aid substances into the washing tub of the machine when the water in the compartment (3) reaches up to a priming level which is higher than the priming level of the first siphon (4).

5 Claims, 1 Drawing Sheet

WASHING AID DISPENSER AND WASHING MACHINE COMPRISING SAID DISPENSER

The present invention refers to a dispenser of washing products and aids, such as detergents or whiteners, fabrics softeners, scents and similar aids, for use in connection with a washing machine, such as a clothes washing machines.

It is largely known that these products and substances are poured by the user into the specially provided compartments of the dispenser before the machine is started, and are thereafter introduced from such a dispenser into the washing tub of the machine at pre-established times and phases of the washing cycle being performed. Currently used detergent dispensers are generally provided as a single-piece component part comprising at least two distinct compartments adapted to receive and hold washing powders or liquids on the one side and, on the other side, generally liquid rinsing aids. For transferring washing aids from the dispenser into the washing tub of the machine, one or more siphons are usually provided within the compartment or compartments containing such substances; the inflow of water into the dispenser in the phase of the washing cycle that calls for such washing aids to be introduced in the washing tub causes, upon reaching the necessary water head, the siphon to be triggered, i.e. primed into working and, as a result, the washing aid concerned to be drawn in from the dispenser and conveyed towards the washing tub duly mixed with the inflowing water, owing to the suction effect of the siphon.

Owing to the wide variety of washing and rinsing aid products that are currently available on the market, the siphon finds itself facing the problem of having to work with, i.e. handle products of differing densities, such as for instance very thick, i.e. high-density concentrated fabric softeners and low-density, more fluent fabric softener, depending on the user's choices when buying such products.

A typical drawback which is encountered with currently used types of dispensers lies in the fact that, owing to the differing physical-chemical properties of the products, the siphon is not able to perform in the desired manner as far as its suction capability is concerned, and this in particular implies a presence of residues on the bottom of the related compartment in the dispenser at the end of the washing cycle, which may even lead to a clogging of the siphon in the long run.

Such a drawback might be overcome through an increase in the inflow pressure of the water supplied to the dispenser, but this would unavoidably give rise to excessive frothing during mixing with the washing aid substance, so as to anyway cause the siphon to work irregularly. In addition, this may in some cases even cause suds, i.e. water and excess foam, to spill over the dispenser and cause a lot of inconvenience and even damages to parts and things near the place in which the machine is installed.

Another possible solution in this connection lies in increasing the negative pressure generated by the siphon so as to obtain a greater draw-in or suction capability. This solution, however, would not be effective in solving the problem in a really satisfactory manner, since it implies an increase in the size of the siphon and, as a result, of the whole dispenser, in contrast with the construction-related limitations imposed by the machine requiring extremely reduced sizes in general.

It therefore is a main purpose of the present invention to do away with the above-mentioned drawbacks of prior-art solutions by providing a washing aid dispenser for washing machines, which is capable of working in an optimum manner with products of different densities.

Within such a general scope of the invention, a further purpose is to provide a washing aid dispenser which is capable of ensuring complete removal, i.e. suction of the washing aid substances into the washing tub of the machine during pre-determined phases of the washing cycle, as well as complete removal of any remnant of said washing substances from the bottom of the respective compartments in the dispenser at the end of the washing cycle.

Another major purpose of the present invention is to provide a washing aid dispenser which is capable of reaching the above specified aims in a manner that is fully reliable and safe for the user, in particular without giving rise to any excessive frothing, i.e. formation of foam inside the dispenser itself.

A further major purpose yet of the present invention is to provide a washing aid dispenser which is capable of reaching the above specified aims while keeping sizes and space requirements in general unaltered or, anyway, substantially within due limits, so as to comply with the construction-related limitations imposed by the machine.

A last, but not least purpose of the present invention is to provide a washing aid dispenser which is low in costs and capable of being manufactured with the use of existing, readily available materials, techniques and machinery.

According to the present invention, these aims and advantages, along with further ones that will become apparent from the following description, are reached in a washing aid dispenser for washing machines incorporating the characteristics as recited and defined in the appended claim 1.

Anyway, features and advantages of the present invention may be more readily understood from the description of a preferred, although not sole embodiment that is given below by way of non-limiting example with reference to the accompanying drawing, in which.

Figure 1:
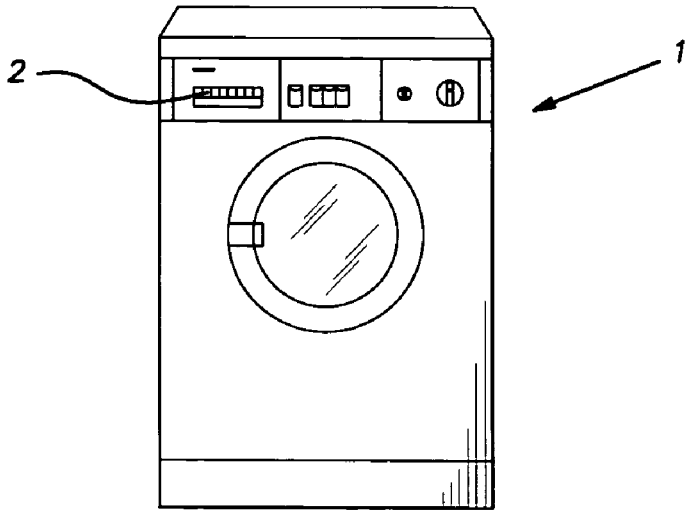
FIG. 1 is a schematic front view of a washing machine incorporating the washing aid dispenser according to the present invention.

With reference to FIG. 1 cited above, the reference numeral 1 is used to generally indicate a washing machine, such as a clothes washing machine, incorporating a washing aid dispenser 2, which is adapted to be pulled out of the main body of the washing machine 1 itself so as to enable the user to fill the washing aid products, such as washing powders or liquids, fabric softeners, whiteners, scents and similar aids, into the respective compartments before starting the washing machine to go through the selected washing cycle.

The washing aid dispenser 2 comprises at least a compartment 3 adapted to contain washing aids, in particular fabric softeners, which is in communication with water supply means (not shown) adapted to deliver water coming from the machine 1. These water supply means are adapted to let in certain phases of the washing cycle water into the dispenser 2, where it mixes up with the washing aid substance contained inside the dispenser itself; the resulting mixture is then delivered into the washing tub of the machine 1.

Inside the compartment 3 there is provided a first siphon 4 to draw in the above mentioned mixture from the dispenser and convey it towards the washing tub of the machine. In the exemplified embodiment, such a first siphon 4 is formed by a first conduit 5, which is open at both its opposite ends and is associated to a first cap piece 6 situated thereabove. The suction, i.e. drawing-in action starts as soon as the water flowing into the dispenser 2 reaches the level, i.e. the head required to prime or trigger said first siphon 4 into working, said level or head being defined by the distance of the inner summit 7 of the first cap piece 6 to the bottom 8 of the dispenser 2.

A peculiar feature of the present invention lies in the fact that the compartment 3 is provided with at least a second siphon 9, which is in turn formed by a second conduit 10 which is open at both ends thereof and associated to a second cap piece 11 situated thereabove. This second conduit 10 has a height and a diameter that are differentiated with respect to the first conduit 5. With reference to the embodiment illustrated in FIG. 2, the second conduit 10 has a greater height and a larger diameter than the first conduit 5. As a result, even the height of the water head of the second siphon 9 will be greater than the one of the first siphon 4.

Figure 2:
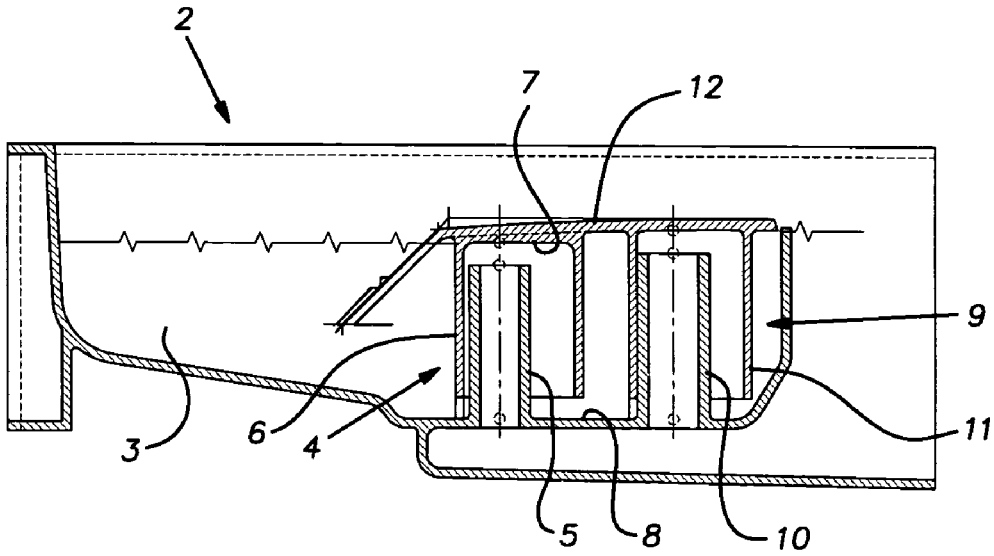
FIG. 2 is a longitudinal-sectional view of an embodiment of the washing aid dispenser according to the present invention.

Advantageously, said first cap piece 6 and said second cap piece 11 may be made as a single-piece part 12, so as this is illustrated in FIG. 2.

The above described arrangement works as follows: as soon as the water is let into the washing aid dispenser 2, it starts to mix up with the washing aid, e.g. the fabric softener, that has been previously filled in the same dispenser. When the water level rises above the inner summit 7 of the first siphon 4, the latter is primed, i.e. triggered into working, and the water+softener mixture starts to be drawn-in, at a low flow rate, to be conveyed towards the washing tub of the machine. As the water level continues to rise, even the second siphon 9 is primed, i.e. triggered into working and, owing to the larger diameter thereof, starts to deliver said mixture to the washing tub of the machine at a greater flow rate. The difference in the diameter of the two conduits 5 and 10 to each other enables the mixture in the dispenser to be drawn-in and removed from the dispenser itself for delivery into the washing tub of the machine in an optimum manner both in the presence of low-density washing aids, which are drawn-in by both the first siphon 4 and, if necessary, the second siphon 9, and high-density concentrated products for which said first siphon 4, that would prove insufficient, is duly assisted by the second siphon 9 having a larger diameter. Such a provision of a second siphon 9 is therefore effective in reducing the likelihood that the first siphon 4 might fail to work properly, or stop working at all, by relieving it of a good deal of its workload. Additionally, it enables the removal of washing aid residues accumulating in the dispenser at the end of each washing cycle performed by the machine to be significantly improved, thereby avoiding or, anyway, significantly reducing the possibility for said first siphon 4 to become clogged. A further advantage deriving from the above mentioned size difference of the two siphons 4 and 9 to each other lies in the fact that, in the case of an excessive level of liquor (in which both the water and the water+fabric softener mixture are actually meant by this term) in the dispenser, said second siphon 9, that, owing to a higher water head thereof, would be triggered into working when a threshold level of potential risk is reached, is actually capable of draining a greater amount of liquor off the dispenser owing exactly to its being provided with a larger diameter.

From the above description it can therefore be readily appreciated that the washing aid dispenser according to the present invention is actually able to fully reach the afore stated aims and provide the desired advantages: in fact, the provision of such two differently sized siphons enables both low-density washing aids and high-density concentrated products to be drawn in, removed and delivered to the washing tub in an optimum manner.

The so devised arrangement according to the present invention further enables the effectiveness in removing any possible residue or remnant from the bottom of the dispenser to be significantly enhanced. Conclusively, the twofold advantage is achieved of a more rational and efficient utilization of the washing aid products and an enhanced cleanliness and reliability of the machine in general, thanks to a reduced likelihood of the siphons to become clogged.

It should furthermore be noticed how the initially proposed advantages are actually achieved by keeping the operating pressures of the water and the overall size of the dispenser substantially unaltered.

It shall be appreciated that the above described washing aid dispenser may be the subject of a number of modifications and variants without departing from the scope of the present invention. Even the materials used to implement the dispenser of the present invention, as well as the shape, form and size of the individual component parts thereof may be from case to case selected to most appropriately comply with particular needs and requirements without departing from the scope of the present invention.

The invention claimed is:

1. Washing aid dispenser for a washing machine comprising a washing tub adapted to be at least partially supplied with water through said dispenser, the dispenser comprising a compartment adapted to contain washing aid substances and a discharge region, the compartment comprising:

a first siphon having pre-determined head and diameter and adapted to transfer said washing aid substances into the washing tub of the machine when the water in said compartment reaches up to a first priming level corresponding to said pre-determined head; and a second siphon having a higher head and a larger diameter than said first siphon, said second siphon being adapted to transfer said washing aid substances into the washing tub of the machine when the water in said compartment reaches up to a second priming level that is higher than the first priming level of the first siphon, said first and second siphons each having an inlet end in said compartment to be filled by water entering the compartment and an outlet end discharging to said discharge region, wherein the dispenser is adapted to transfer said washing aid substances contained in the compartment through both the first siphon and the second siphon once the water reaches the second priming level.

2. Washing aid dispenser according to claim 1, wherein the height of said second siphon with respect to a bottom of said washing aid dispenser is greater than the height of said first siphon.

3. Washing aid dispenser according to claim 1, wherein said first siphon comprises a first conduit associated to a first cap piece situated thereabove, and said second siphon comprises a second conduit associated to a second cap piece situated thereabove, wherein each one of said first and second conduits comprises a pair of open opposite extremities.

4. Washing aid dispenser according to claim 3, characterized in that said first and said second cap pieces are made in the form of a single-piece part.

5. Washing machine comprising a washing aid dispenser as claimed in claim 1.

* * * * *